United States Patent [19]

Silver

[11] 4,299,391

[45] Nov. 10, 1981

[54] SEQUENCE FORMING AND ALIGNMENT GAME

[76] Inventor: Sol Silver, 290 Ninth Ave., New York, N.Y. 10001

[21] Appl. No.: 133,961

[22] Filed: Mar. 26, 1980

[51] Int. Cl.[3] ..... A63F 3/00

[52] U.S. Cl. ..... 273/271; 273/272

[58] Field of Search ..... 273/271, 272, 299

[56] References Cited

U.S. PATENT DOCUMENTS

| | | | |
|---|---|---|---|
| 943,058 | 12/1909 | Ashenden | 273/299 |
| 977,117 | 11/1910 | McPherson | 273/299 |
| 1,320,628 | 11/1919 | Lowman | 273/299 |
| 1,332,249 | 3/1920 | Feero | 273/299 |
| 1,553,835 | 9/1925 | Peters | 273/272 |
| 1,633,445 | 6/1927 | Gail et al. | 273/272 |
| 3,053,537 | 9/1962 | Moss | 273/299 X |
| 4,026,558 | 5/1977 | Patin | 273/299 |

OTHER PUBLICATIONS

Rules for Game of Boggle®.

*Primary Examiner*—Anton O. Oechsle
*Attorney, Agent, or Firm*—Pennie & Edmonds

[57] ABSTRACT

A sequence forming and alignment game is described using two sets of markers, on each of which is marked one or more alphanumeric characters. In the preferred embodiment each of the markers is divided in half and a letter appears on each half. The markers are placed one at a time on a playing surface alternately from one set and then the other. Each marker is placed so as to form a word using at least one of the letters on the marker being placed and one or more letters on other markers previously placed on the playing surface. The orientation of each marker at the time of its placement is governed by the length of the word that can be spelled during that turn of play. Previously played markers can be replaced during play provided that the replacing marker can be usd to spell out a word that is longer than that in which the replaced marker was used. The game is won when at least four, and preferably five markers from one set are all in a row on the playing surface.

21 Claims, 2 Drawing Figures

SEQUENCE FORMING AND ALIGNMENT GAME

BACKGROUND AND SUMMARY OF THE INVENTION

This relates to a sequence forming and alignment game which combines aspects of conventional word spelling games with aspects of alignment games such as Tic Tac Toe and Bingo.

The game is intended for two players, or two teams. It uses two sets of flat tiles or markers, each set being distinguished by a different color, and a playing surface designed to receive five rows and five columns of such markers. In the preferred embodiment the upper surface of each of the markers is divided in half and a letter appears on each half. At the start of play, each team receives one set of markers. On each team's turn, a player draws one of his team's markers sight unseen from its set of markers; and he then attempts to place this marker on the playing surface so as to form a word using at least one of the letters on the marker he has drawn and the letters on other markers previously placed on the playing surface. Each marker must be placed so that it is contiguous to at least one previously placed marker; and one letter of the marker that is placed must begin the word that is formed.

The orientation of each marker at the time of its placement is governed by the length of the word that can be spelled during that turn of play. By way of illustration, the marker is oriented toward the right when the word formed is three letters long, it is upside down when it is four letters long, it is oriented toward the left when it is five letters long and it is right side up when it is six or more letters long.

The game is won when five markers from one set are all in a row, either horizontal, vertical or diagonal. In the event this condition is not met when the game board is finally filled with markers, the winner is determined by point scoring based on the length of the words formed by each team.

Previously played markers can be replaced during play provided that the replacing marker can be used to spell out a longer word than that for which the replaced marker was used. The orientation of the replaced marker will of course indicate how long the previous word was. No replacement is permitted, however, for markers that had been used to form words of six letters or more.

BRIEF DESCRIPTION OF THE DRAWINGS

These and other objectives, features and elements of my invention will be more readily apparent from the following detailed description of the drawing in which.

BEST MODE FOR CARRYING OUT THE INVENTION

Figure 1:
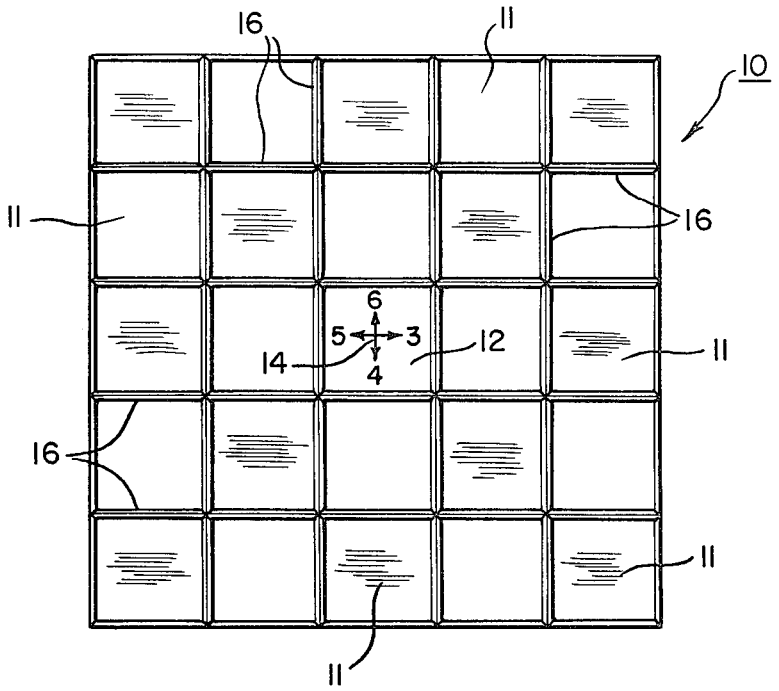
FIG. 1 is a schematic representation of an illustrative embodiment of my invention.
Figure 2:
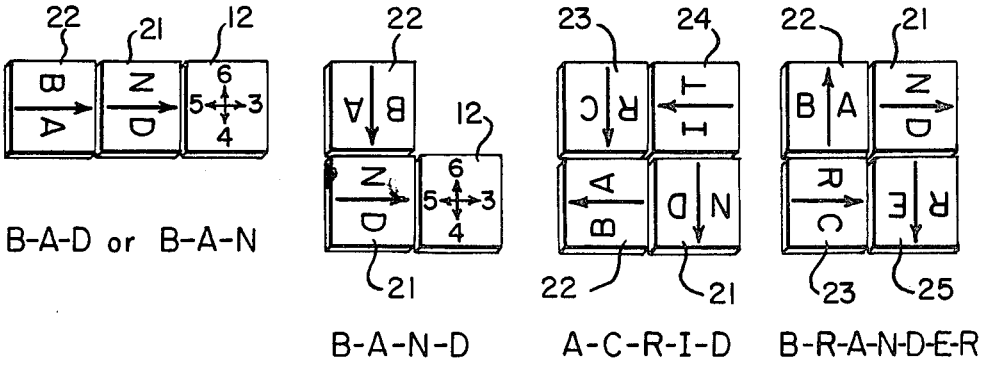
FIG. 2 depicts an example of a sequence of play in accordance with my invention.

As shown in FIG. 1 the playing surface used in my invention is a board 10 made up of a 5×5 matrix of squares 11. Preferably the squares are defined by raised ridges 16 spaced apart so that square playing markers or tiles may be placed in between. Center square 12 is a "wild" square which is assumed to represent a marker or tile bearing any one letter the player needs in forming a word. Several illustrative playing tiles 21–25, are shown in FIG. 2. As is apparent, each tile bears two letters and an arrow.

Two sets of such tiles are used in my game. Each set contains 29 tiles with two letters on each tile and each set is distinguished by a different color. The particular letters used can vary widely, and the tiles in each set are preferably different. In general most of the tiles have a vowel and a consonant on them. It is not necessary that all the consonants be included, but obviously, if any are to be omitted they should be those which are infrequently used. Alternatively, little used letters should appear only once on the 58 tiles used in the game.

The arrow on the tile is used to divide the tile in half and to orient the tile at the time it is placed on the board. The arrow is aligned in the directions right, left, up or down, in accordance with the length of the word spelled out as a result of the placement of the tile. Illustratively, the minimum length of a word used in playing the game is three letters and a tile which is placed to form a three letter word is oriented so that the arrow points to the right. If the word is four letters long the tile must be placed so that the arrow points down; if it is five letters long the tile must be placed so that the arrow points to the left and if the word is six characters or more the tile must be placed so that it points up. These directions, of course, are relative to the playing surface of the board and center square 12 of the board conveniently contains a compass point 14 indicating the word lengths 3, 4, 5 and 6 associated with the four directions.

My game is intended for two players or two teams. To begin play each team receives one set of 29 tiles and the teams determine who is the first to play. On each play, a player draws one of his team's tiles sight unseen from its set of tiles and attempts to place this tile on the playing surface so as to form a word. On the first play a tile must be placed on one of the four squares contiguous with center square 12. Since the center square can be used as any one letter in forming a word, the placed tile must form a three letter word and accordingly is oriented so that the arrow on the tile points to the right.

After the first tile is placed, the second tile is placed so that (1) it is contiguous to either the first tile or the center square and (2) one of its letters begins a word using one or both letters on the second tile, one or both letters on the first tile and/or an assumed letter on the center square. While different rules of word construction may be used, I have found it preferable to require that each letter in the word that is formed be adjacent on the playing surface to the next following letter in the word. Again, the orientation of the tile is such that the arrow on the tile indicates the length of the word formed as a result of the placement of the tile.

Thereafter each turn is made either (1) by placing a tile on an empty square contiguous to the center square or a previously played tile or (2) by replacing any previously played tile. Replacement, however, may only be made if (1) the tile replaced was part of a word that was less than six letters long and (2) the new word formed is at least one letter longer than the word formed by the replaced tile. As will be apparent, the direction of the arrow on the replaced tile will reveal the length of the word formed by that tile; and if the arrow points up the tile can no longer be replaced since it is part of a six letter word.

The game ends when five tiles of the same color are all in a row, either horizontal, vertical or diagonal. For the formation of rows using center square 12, the square is assumed to be a tile having the color of the other tiles in the row the player is seeking to form. If desired, the complexity of the game could be decreased by ending the game if there are four tiles of the same color in a row.

A situation may arise in which the entire board is filled with tiles before the game is ended. In that case the winner is determined by the length of the letters in the words that are formed. Illustratively, 10 points might be given for a word of six letters or more, seven points for a five letter word, four points for a four letter word and no points for a three letter word. Different point schemes could be used as handicaps for players of different ages or abilities. In addition, the length of the words required to be formed can be varied for the different players in a game or for different games. For example, for one player in a game, the four possible orientations of the tile might correspond to words of 2, 3, 4 and 5 letters in length, while for another player they might correspond to words of 4, 5, 6 and 7 characters.

The method of play is illustrated in FIG. 2. Initially a tile 21 bearing the letters D and N is put in place on the playing surface contiguous to center square 12. The center square is assumed to be the letter E, to spell out the word DEN. Since this word is three letters long, the tile is oriented so that the arrow points to the right. Next, a tile 22 bearing the letters B and A is placed to the left of tile 21 to form the word BAD or the word BAN. Since this word is also three letters long, the tile is oriented so that the arrow points to the right.

The letters on tiles 21 and 22 also spell out the word BAND. However, since BAND is a four letter word, tile 22 would have to be oriented upside down. In such orientation and with tile 22 positioned to the left of tile 21, it is not possible to form the word BAND is accordance with the preferred rule of word construction since the letter A is not adjacent on the playing surface to the next following letter N in the word BAND. The word BAND can be formed as shown in the second example of FIG. 2, by placing tile 22 above tile 21. In that position and with the upside down orientation required for a four letter word, both B and A are adjacent to N and the word BAND can be formed in accordance with the rule on word construction. Alternatively a five letter word BANDY could be spelled with tiles 21 and 22 by assuming that the letter on the center square is Y. In such a case, tile 22 would have to be oriented so that its arrow points to the left and tile 22 would have to be placed to the left of tile 21.

As is evident, this rule on word formation interacts with the rule on the orientation of the tile so as to limit the words that can be formed for a tile placed in a given orientation. While this adds to the enjoyment of the game, the rule can be relaxed for younger players, For example, words could be constructed so that each character is on a marker that is the same as or contiguous to the marker on which is located the next following letter in the word being formed. Alternatively the rule could be made stricter by requiring that each letter be contiguous with the next following letter such that the letters touch along at least a portion of one side rather than merely at a point as in the case of A and N in the example of BAN shown in FIG. 2.

In the third example of FIG. 2, tile 22 is placed so as to form the five letter word ACRID using the A from tile 22, the C and R from tile 23, the I from tile 24 and the D from tile 21. Since the word so formed is five letters long, tile 22 must be oriented so that its arrow points to the left.

In the fourth example of FIG. 2, tile 22 is placed to form the seven letter word BRANDER using the B from tile 22, the R from tile 23, the A from tile 22, the N and D from tile 21 and the E and R from tile 25. Since this is a seven letter word tile 22 must be oriented so that its arrow points up.

As will be apparent, my game may be played in numerous forms and with many variations in the rules, several of which have been described above. The number of markers used can be varied widely. If desired, one or more blank markers can be used to represent letters of the player's choice. While the use of markers bearing two letters each is preferred, the game can be played with markers bearing one letter or several. The use of markers bearing only one letter simplifies the word construction rule and may be desirable in games intended for young children. The game need not be limited to a word game; it can be played using mathematical symbols to form equations rather than letters to form sentences. Alternatively each marker could bear one or more words and the words could be combined into sentences.

Preferably one of the letters on the tile that is played should begin a word. For a less complicated game, however, the letter on the tile in play need only be part of the word that is formed. While it is preferred that a letter be used only once in forming a word and that no credit be given for the use of S to form plurals, these rules can be varied as desired.

While the use of a $5\times5$ board is preferred, boards with a different number of squares and different numbers of rows and/or columns could be used. Alternatively, the game can be played on any surface without using a playing board at all. Instead of square spaces and tiles, other regular polygons such as triangular or hexagonal spaces and tiles could also be used but the tiles should be placed on the playing surface so that they are contiguous to at least one other tile.

The use of a wild space is not necessary. Play could be started simply by putting down a blank tile or any tile without regard to whether it formed a word. Alternatively, especially if larger boards are used, multiple wild spaces could be used on the playing surface.

What is claimed is:

1. A method of playing a sequence forming and alignment game using a playing surface having a matrix of spaces and two sets of markers, each of said markers bearing two letters and being sized to fit in one of said spaces, said method comprising the steps of placing said markers one at a time on the spaces of said playing surface in accordance with at least the following rules:

the first marker is placed on a space of said playing surface contiguous to a predetermined "wild" space which is assumed to represent a letter;

each subsequent marker is placed on a space of said playing surface so that it is contiguous to at least one previously placed marker or said wild space;

the placement of markers alternates between the two sets of markers;

in the placement of a marker, a word must be formed using at least one letter on the marker that is placed and one or more letters from previously placed markers, or the wild space;

each marker is oriented on the playing surface in accordance with the number of letters in the word formed by its placement;

a previously placed marker may be replaced by another if the number of letters in a word formed by such relacement is longer than the number of letters in the word that had been formed by the marker that is replaced; and the game is ended when at least four markers from one set are in a row on the playing surface.

2. A method of playing a sequence forming and alignment game using two sets of markers, each of said markers bearing at least one alphanumeric character, said method comprising the steps of placing said markers one at a time on a playing surface in accordance with at least the following rules:

the placement of markers alternates between the two sets of markers;

in the placement of a marker, an intelligible sequence must be formed using at least one character on the marker that is placed and one or more characters available on the playing surface;

each marker is oriented on the playing surface in accordance with the number of characters in the intelligible sequence formed by its placement;

a previously placed marker may be replaced by another if the number of characters in an intelligible sequence formed by such replacement is longer than the number of characters in the intelligible sequence that had been formed by the marker that is replaced; and the game is ended when at least four markers from one set are in a row.

3. A method of playing a sequence forming and alignment game using a playing surface having a matrix of spaces and two sets of markers, each of said markers bearing two letters and being sized to fit in one of said spaces, said method comprising the steps of:

placing a marker on a space of said playing surface contiguous to a predetermined "wild" space which is assumed to represent a letter;

placing each subsequent marker on a space of said playing surface so that it is contiguous to at least one prevously placed marker or said wild space;

alternating the placement of markers between the two sets of markers;

in the placement of a marker, forming a word using at least one on the marker that is placed and one or more letters from previously placed markers, or the wild space;

orienting the placement of each marker on the playing surface in accordance with the number of letters in the word formed by its placement;

permitting replacement of a previously placed marker during the step of placing another marker if the number of letters in a word formed by such replacement is longer than the number of letters in the word that has been formed by the marker that is replaced; and endingthe game when at least four markers from one set are in a row on the playing surface.

4. A method of playing a sequence forming and alignment game using at least two sets of markers, each of said markers bearing at least one alphanumeric character, said method comprising the steps of:

placing said markers one at a time on a playing surface with the placement of markers alternating between the sets of markers in the game;

in the placement of a marker, forming an intelligible sequence using at least one character on the marker that is placed and one or more characters available on the playing surface;

orienting the placement of each marker on the playing surface in accordance with the number of characters in the intelligible sequence formed by its placement;

permitting replacement of a previously placed marker during the step of placing another marker if the number of characters in an intelligible sequence formed by such replacement is longer than the number of characters in the intelligible sequence that had been formed by the marker that is replaced; and ending the game when at least four markers from one set are in a row on the playing surface.

5. A method of playing a sequence forming and alignment game using at least two sets of markers, each of said markers bearing at least one alphanumeric character, said method comprising the steps of:

placing said markers one at a time on a playing surface so that the marker that is placed is contiguous to a previously placed marker, the placement of said markers alternating between the sets of markers in the game;

in the placement of a marker, forming an intelligible sequence using at least one character on the marker that is placed and one or more characters available on the playing surface, the sequence formed being made of characters that are adjacent on the playing surface to the next following character in the sequence;

orienting the placement of each marker on the playing surface in accordance with the number of characters in the intelligible sequence formed by its placement; and ending the game when at least four markers from the same set are in a row.

6. The method of claim 2, claim 4, or claim 5 wherein each marker bears two letters of the alphabet, not necessarily different letters.

7. The method of claim 4 or claim 5 wherein the first marker that is placed on the playing surface is placed contiguous to a predetermined space on said surface and said space is assumed to represent a marker bearing an alphanumeric character of the player's choice useful in forming an intelligible sequence.

8. The method of claim 4 or claim 5 wherein each marker, except the first is placed on the playing surface so that it is contiguous to at least one previously placed marker on the playing surface.

9. The method of claim 4 or claim 5 wherein the first marker placed is placed so that it is contiguous to a wild space on the playing surface that is assumed to represent an alphanumeric character and each subsequent marker is placed so that it adjoins at least one previously placed marker on the playing surface or said wild space.

10. The method of any one of claims 1, 2, 3 or 4 wherein a previously placed marker may not be replaced if it is oriented in a particular direction.

11. The method of any one of claims 1, 2, 3 or 4 wherein the playing surface is a $5\times5$ matrix of spaces each of which is sized to receive one marker.

12. The method of claim 1 or claim 3 wherein the word that is formed during placement of a marker must be made of letters that are adjacent on the playing surface to the next following letter in the word.

13. The method of claim 2 or claim 4 wherein the intelligible sequence that is formed during placement of a marker must be made of characters that are adjacent on the playing surface to the next following character in the sequence.

14. The method of claim 1 or claim 3 wherein the word that is formed during placement of a marker must be made of letters that are on a marker that is the same as or contiguous to the marker on which is located the next following letter in the word.

15. The method of claim 4 or claim 5 wherein the intelligible sequence that is formed during placement of a marker must be made of characters that are on a marker that is the same as or contiguous to the marker on which is located the next following character in the sequence.

16. The method of claim 4 or claim 5 wherein each marker bears a single letter of the alphabet.

17. The method of any one of claims 1, 2, 3, 4, or 5 wherein the game is ended when 5 markers from one set are in a row.

18. The method of claim 1 or claim 3 wherein the wild space is counted as one of the markers in a set in determining when there are at least four markers of that set in a row.

19. The method of claim 4 or claim 5 wherein at least one wild space is provided on the playing surface and the wild space is counted as one of the markers in a set in determining when there are at least four markers of that set in a row.

20. The method of claim 1 or claim 3 wherein a letter on the marker that is placed is the first letter of the word that is formed.

21. The method of claim 4 or claim 5 wherein a character on the marker that is played is the first character in the intelligible sequence that is formed.

* * * * *

UNITED STATES PATENT AND TRADEMARK OFFICE

CERTIFICATE OF CORRECTION

PATENT NO. : 4,299,391

DATED : November 10, 1981

INVENTOR(S) : Sol Silver

It is certified that error appears in the above—identified patent and that said Letters Patent is hereby corrected as shown below:

[57] Abstract, line 15, "usd" should read -- used --

Column 3, line 36 "is accordance" should read -- in accordance --

Column 5, line 3, "relacement" should read -- replacement --

Column 5, line 46, "least one on the marker" should read -- least one letter on the marker --

Column 5, line 58, "endingthe game" should read -- ending the game --

Column 8, line 17, "played" should read -- placed --

Signed and Sealed this

*Twenty-sixth* Day of *January 1982*

[SEAL]

*Attest:*

*Attesting Officer*

GERALD J. MOSSINGHOFF

*Commissioner of Patents and Trademarks*